US007378061B2

(12) United States Patent
Barnard

(10) Patent No.: US 7,378,061 B2
(45) Date of Patent: May 27, 2008

(54) INNER CONE FOR CONVERTER ASSEMBLY

(75) Inventor: Kevin A. Barnard, Franklin, IN (US)

(73) Assignee: EMOON Technologies LLC, Wilmington, DE (US)

( * ) Notice: Subject to any disclaimer, the term of this patent is extended or adjusted under 35 U.S.C. 154(b) by 609 days.

(21) Appl. No.: 10/952,050

(22) Filed: Sep. 28, 2004

(65) Prior Publication Data

US 2006/0070236 A1 Apr. 6, 2006

(51) Int. Cl.
*B01D 50/00* (2006.01)
*B01D 53/34* (2006.01)

(52) U.S. Cl. ..... 422/179; 422/173; 422/177; 422/178; 422/180; 422/190

(58) Field of Classification Search ..... 422/173, 422/177, 176, 179, 180, 190
See application file for complete search history.

(56) References Cited

U.S. PATENT DOCUMENTS 4,002,433 A * 1/1977 Oser ..... 422/176
5,250,269 A * 10/1993 Langer ..... 422/179
5,293,743 A * 3/1994 Usleman et al. ..... 60/299
6,010,668 A 1/2000 Lawrence et al.
2003/0194357 A1* 10/2003 Lancaster et al. ..... 422/177
2004/0013581 A1 1/2004 Burnette

FOREIGN PATENT DOCUMENTS

EP 0 573 834 A1 12/1993
JP 06 288234 10/1994

OTHER PUBLICATIONS

International Search Report, Nov. 4, 2005.

* cited by examiner

*Primary Examiner*—Lessanework T Seifu
(74) *Attorney, Agent, or Firm*—Carlson, Gaskey & Olds

(57) ABSTRACT

A concentric, offset, or obliquely formed spun converter assembly includes an outer shell defining an internal cavity that receives a catalyst substrate. Inner cones are positioned within the internal cavity at each end of the outer shell. Each inner cone has a tapered body portion and a transversely extending shoulder portion that abuts an outer edge of the outer shell. The shoulder portions mechanically lock the inner cones to the outer shell.

27 Claims, 1 Drawing Sheet

INNER CONE FOR CONVERTER ASSEMBLY

TECHNICAL FIELD

The subject invention relates to a converter assembly that includes an inner cone that is mechanically locked to an outer shell to prevent relative movement between the outer shell and the inner cone.

BACKGROUND OF THE INVENTION

A converter assembly includes an outer shell defining an internal cavity that receives a catalyst substrate. Inner cones are installed within the internal cavity at each end of the outer shell. In some configurations, the inner cones are spaced apart from the outer shell forming an air gap for insulation. In other configurations, an insulating mat is compressed between each of the inner cones and the outer shell to provide insulation.

Traditionally, in either configuration, the inner cones float within the internal cavity, i.e. the inner cones are not attached to the outer shell. Using the insulating mat restricts movement of the inner cones but does not prevent relative movement between the inner cones and outer shell. This floating relationship can generate undesirable acoustic effects, compromise insulation characteristics, or can damage the catalyst substrate. One solution has been to spot weld the inner cones to the outer shell, but this increases cost and assembly time.

Another disadvantage with current inner cone design concerns connecting elements that are attached to the converter assembly. The converter assembly includes connecting flange members and/or pipe connections that are welded onto each end of the outer shell to allow the converter assembly to be connected to other exhaust system components. In order to attach the connecting flange members to the outer shell, a welding operation is performed on an inside diameter of the connecting flange member and at an inside diameter of the inner cone. When attaching pipe connections to the outer shell, a welding operation is performed on an outside diameter of the pipe connection. These welding operations are difficult, time consuming, and expensive. Further, welding on the inside diameter on connecting flange members can generate splatter that can erode the catalyst substrate.

Thus, there is a need for an inner cone design that can be attached to an outer shell of a converter assembly without requiring cost prohibitive welding operations. The inner cone design should also provide for easier attachment of connecting members to the outer shell as well as overcoming the other above-mentioned deficiencies with the prior art.

SUMMARY OF THE INVENTION

A converter assembly includes an outer shell defining an internal cavity. At least one inner cone is received within the internal cavity. The inner cone has a longitudinally extending body that has a retention feature formed at one end. The retention feature mechanically locks the inner cone to the outer shell.

In one example, the inner cone has a longitudinal body that has a first end received within the internal cavity and a second end extending out of the internal cavity. The retention feature includes a shoulder portion, formed at the second end, which abuts against an external edge of the outer shell. The shoulder portion prevents linear movement of the inner cone relative to the outer shell. The first end has a tapered body portion and the second end has a tubular portion that transitions into the tapered body portion. The tapered body portion has a variable diameter and/or variable circumference and the tubular portion has a generally constant diameter and/or constant circumference. The shoulder portion is formed about one end of the tubular portion.

In one embodiment, the converter assembly includes a pair of inner cones. A first inner cone is positioned within the internal cavity at one end of the outer shell and a second inner cone is positioned within the internal cavity at an opposite end of the outer shell. The first inner cone includes a first shoulder portion that mechanically locks the first inner cone to the one end of the outer shell and the second inner cone includes a second shoulder portion that mechanically locks the second inner cone to the opposite end of the outer shell. A catalyst substrate is positioned within the internal cavity between the first and second inner cones.

In one example, insulating mat material is compressed between an outer surface of the first and second inner cones and an inner surface of the outer shell. The first and second shoulder portions and the insulating mat material prevent the first and second inner cones from moving relative to the outer shell. If insulating mat material is not used, an air gap between the first and second inner cones and the outer shell provides insulation.

In one example, flange connector members are welded to each end of the converter for connection to other exhaust system components. The flange connector members are welded to the outer surface adjacent to the first and/or second shoulder portions. Due to the shoulder portions on the inner cones, welding is not required on an inside diameter. This facilitates assembly and reduces cost. These and other features of the present invention can be best understood from the following specification and drawings, the following of which is a brief description.

DETAILED DESCRIPTION OF THE PREFERRED EMBODIMENT

Figure 1:
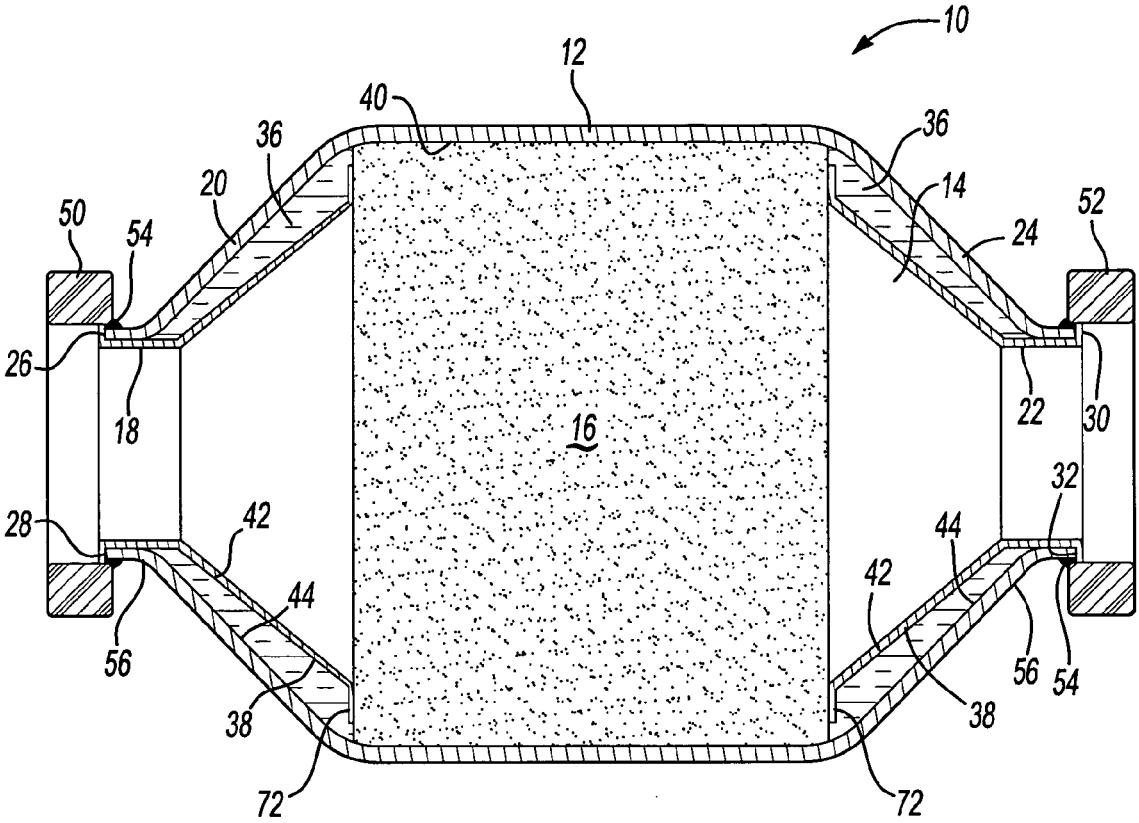
FIG. 1 is a cross-sectional view of a converter assembly incorporating the subject invention.

A converter assembly for an exhaust system is shown generally at 10 in FIG. 1. The converter assembly 10 includes an outer shell 12, also referred to as a can, which defines an internal cavity 14. The converter assembly 10 can operate with or without a substrate depending upon design requirements. In the example shown in FIG. 1, the converter assembly 10 includes a catalyst substrate 16.

The catalyst substrate 16 is received within the internal cavity 14. As known, the catalyst substrate 16 is a substance that speeds up a chemical reaction rate. In an automotive exhaust application, the catalyst substrate 16 comprises an inert substance onto which an active wash coat is added. The catalyst substrate 16 speeds up oxidation of unconverted hydrocarbons and carbon monoxide into water and carbon dioxide. The materials used for the inert substance and active wash coat, and the operation of a catalytic converter is well known and will not be discussed in further detail.

The converter assembly 10 includes a first inner cone 18 at one end 20 of the outer shell 12 and a second inner cone 22 at an opposite end 24 of the outer shell 12. The first inner cone 18 includes a first shoulder portion 26 that abuts against a first edge 28 of the outer shell 12 and the second inner cone 22 includes a second shoulder portion 30 that abuts against a second edge 32 of the outer shell. The first 26 and second 30 shoulder portions mechanically lock the first 18 and second 22 inner cones to the outer shell 12. This mechanical lock interface prevents linear movement of the first 18 and second 22 inner cones relative to the outer shell 12 in a direction into the internal cavity 14.

It should be understood that while two cones are shown in FIG. 1, the converter assembly 10 could also be configured to include only one cone. The cones provide insulation for the converter assembly 10. Further, one of the first 18 or second 22 inner cones is an inlet cone and the other of the first 18 or second 22 inner cones is an outlet cone. Exhaust flows from an exhaust inlet to an exhaust outlet as known.

In one example, mats 36 are compressed between an outer surface 38 of each of the first 18 and second 22 inner cones and an inner surface 40 of the outer shell 12. The mats 36 provide additional insulation and help reduce noise. Any type of insulating mat material known in the art could be used for mats 36. Further, depending upon design requirements, mats 36 may not be required for additional insulation. When mats 36 are not used, an air gap formed between the first 18 and second 22 inner cones and the inner surface 40 of the outer shell 12 may provide sufficient insulation. The air gap would be approximate in size to the amount of area used by the mats 36 as shown in FIG. 1.

The first 18 and second 22 inner cones each have an angled body surface 42 that generally corresponds in slope to an angled surface 44 on the outer shell 12. The mats 36 and angled body surfaces 42 of the first 18 and second 22 inner cones cooperate to prevent linear movement of the first 18 and second 22 inner cones relative to the outer shell 12 in a direction out of the internal cavity 14.

A first flange connector 50 is mounted to the one end 20 of the outer shell 12 and a second flange connector 52 is mounted to the opposite end 24 of the outer shell 12. If needed, the first 50 and second 52 flange connectors allow the converter assembly 10 to be connected to other exhaust system components (not shown) as known. The first 50 and second 52 flange connectors are welded at 54 to an external surface 56 of the outer shell 12 adjacent the first 26 and second 30 shoulder portions. It should be understood that the converter assembly 10 may not require any flange connectors, or may require only one flange connector.

Figure 3:
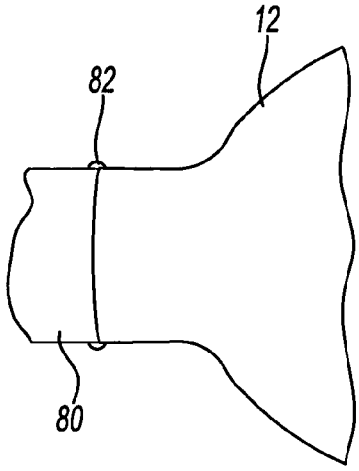
FIG. 3 shows a pipe connection to the converter assembly.

Further, as shown in FIG. 3, pipe connections 80 may be used as connecting elements. Typically, pipe connections 80 are welded on an outside diameter to the outer shell 12. This attachment interface is shown generally at 82.

Figure 2:
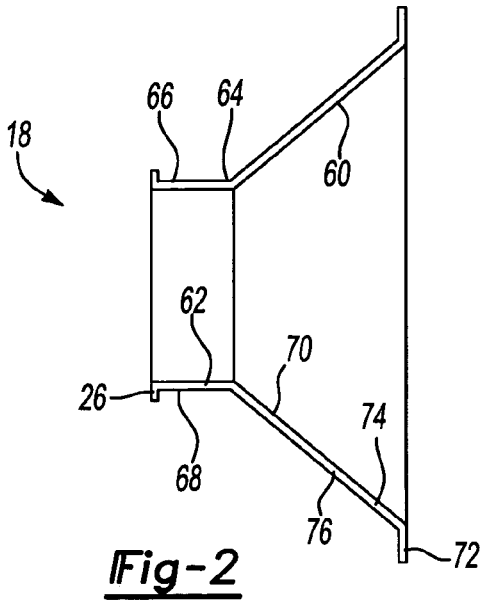
FIG. 2 is a cross-sectional view of one example of an inner cone shown in FIG. 1 that incorporates the subject invention.

Further details of the first inner cone 18 are shown in FIG. 2. While only the first inner cone 18 is shown in FIG. 2, it should be understood that the second inner cone 22 could be similarly formed. The first inner cone 18 includes a longitudinally extending body formed from a first body portion 60 and a second body portion 62. The first body portion 60 is a tapered portion that has a variable diameter and/or variable circumference. The second body portion 62 is a tubular portion that has a generally constant diameter and/or constant circumference. The second body portion 62 is positioned at the one end 20 of the outer shell 12 and transitions into the first body portion 60 at one tube end 64.

The first shoulder portion 26 is formed on the second body portion 62 at an opposite tube end 66. The first shoulder portion 26 extends out of the internal cavity 14 to abut the outer shell 12 as described above. The first shoulder portion 26 is formed transversely relative to the second body portion 62. In the example shown, the first shoulder portion 26 is generally perpendicular to an external surface 68 of the second body portion 62.

The first body portion 60 transitions into the second body portion 62 at one tapered end 70. The second body portion 62 includes a flange 72 formed at an opposite tapered end 74. The flange 72 abuts against the catalyst substrate 16 (see FIG. 1). The flange 72 is formed transversely relative to the first body portion 60. In the example shown, the flange 72 forms an obtuse angle relative to an external surface 76 of the first body portion 60.

The first inner cone 18 is installed within the converter assembly 10 in the following manner. The first inner cone 18 is preformed in the configuration shown in FIG. 2. The first inner cone 18 is held fixed by a collet (not shown) and the outer shell 12 is spun around the first inner cone 18 to form a single piece outer shell 12 with the internal cavity 14. The first shoulder portion 26 abuts the first edge 28 of this spun outer shell 12 to mechanically lock the first inner cone 18 to the outer shell 12. If the second inner cone 22 is required, the installation process would be similar to that of the first inner cone 18.

If a flange connector 50 is required, the flange connector 50 is attached to the external surface 56 of the outer shell 12. Preferably, the flange connector 50 is welded at 54 to the outer shell 12 immediately adjacent to the respective shoulder portion 26.

While the shoulder 26 and flange 72 extend circumferentially about 360° relative to a central axis of the first inner cone 18, it should be understood that the shoulder 26 and/or the flange 72 could be provided by discreetly spaced portions.

The subject invention provides a spun converter assembly that has at least one inner cone mechanically locked to an outer shell. This eliminates the need for spot welding the inner cone to the outer shell and prevents the inner cone from floating within the outer shell. Further, a flange connector can be attached to an end of the converter assembly without requiring welding operations on an inside diameter. This avoids generating splatter, which can adversely affect the catalyst substrate. Any type of spun converter can benefit from this invention including converters formed by concentric, offset and/or oblique spinning, for example. Concentric, offset, and oblique spinning processes are known in the art and will not be discussed in further detail.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A converter assembly comprising:

an outer shell having a cylindrical central portion with conical end portions that cooperate to define an internal cavity;

at least one inner cone having a longitudinal body with a first end extending into said internal cavity and a second end extending outside of said internal cavity, said at least one inner cone being positioned such that said longitudinal body is substantially received within said internal cavity, and wherein said second end includes a retention feature mechanically locking said at least one inner cone to one of said conical end portions of said outer shell.

2. The converter assembly according to claim 1 wherein said retention feature comprises a shoulder extending transverse to said longitudinal body.

3. The converter assembly according to claim 2 wherein said longitudinal body has a tapered portion adjacent said first end and a tubular portion adjacent said second end, said tapered portion having a variable diameter or circumference and said tubular portion having a generally constant diameter or circumference.

4. The converter assembly according to claim 3 wherein said shoulder is formed about one end of said tubular portion.

5. The converter assembly according to claim 4 wherein said shoulder is generally perpendicular to an external surface of said tubular portion.

6. The converter assembly according to claim 4 including a flange connector welded to an external surface of said outer shell adjacent said shoulder.

7. The converter assembly according to claim 4 wherein said shoulder engages an edge of said outer shell to prevent linear movement of said at least one inner cone relative to said outer shell in a first direction.

8. The converter assembly according to claim 7 including an insulating mat compressed between an outer surface of said at least one inner cone and an inner surface of said outer shell, said tapered portion of said at least one inner cone and said insulating mat cooperating to prevent linear movement of said at least one inner cone relative to said outer shell in a second direction opposite from the first direction.

9. The converter assembly according to claim 1 including a catalyst substrate received within said internal cavity.

10. The converter assembly according to claim 1 wherein said at least one inner cone includes a first inner cone received within said internal cavity at one end of said outer shell and a second inner cone received within said internal cavity at an opposite end of said outer shell.

11. The converter assembly according to claim 1 wherein said outer shell comprises a spun converter.

12. The converter assembly according to claim 11 wherein said spun converter is formed from at least one of a concentric, offset, or oblique spinning process.

13. The converter assembly according to claim 1 wherein said outer shell has an exhaust inlet at one of said conical end portions and an exhaust outlet the other of said conical end portions.

14. The converter assembly according to claim 1 including an air gap formed between an outer surface of said at least one inner cone and an inner surface of said outer shell.

15. The converter assembly according to claim 1 including at least one pipe connection welded to an outer diameter of one end of said outer shell.

16. The converter assembly according to claim 1 wherein said outer shell comprises a single-piece spun shell with opposing outer edges at said conical end portions and wherein said retention feature directly abuts against one of said opposing outer edges to mechanically lock said longitudinal body to said outer shell.

17. The converter assembly according to claim 1 wherein said at least one inner cone comprises a single-piece cone that is substantially surrounded by said outer shell.

18. The converter assembly according to claim 17 wherein said outer shell includes angled surfaces extending from opposite ends of said cylindrical central portion to define said conical end portions.

19. The converter assembly according to claim 18 wherein said retention feature comprises a shoulder that abuts directly against an outer edge end surface of one of said conical end portions.

20. A converter assembly comprising:

an outer shell enclosing an internal cavity, said outer shell comprising single-piece component having a cylindrical portion with a first conical end portion extending from said cylindrical portion to an inlet and a second conical end portion extending from said cylindrical portion to an outlet;

at least one inner cone having a longitudinal body wit a first end extending into said internal cavity and a second end extending outside of said internal cavity, said at least one inner cone being positioned such that said longitudinal body is substantially surrounded by one of said first and said second conical end portions, and wherein said second end of said longitudinal body includes a retention feature mechanically locking said at least one inner cone to said one of said first and said second conical end portions.

21. The converter assembly according to claim 20 wherein said at least one inner cone comprises a single-piece component.

22. The converter assembly according to claim 20 wherein said retention feature comprises an outwardly extending shoulder positioned outside of said internal cavity to abut against an end surface of said one of said first and said second conical end portions.

23. The converter assembly according to claim 22 including a substrate positioned within said internal cavity and wherein said longitudinal body includes a flange positioned on an end opposite of said outwardly extending shoulder, said flange abutting against an end face of said substrate.

24. The converter assembly according to claim 22 including a flange connector surrounding said outwardly extending shoulder and welded to an external surface of said outer shell adjacent said outwardly extending shoulder.

25. The converter assembly according to claim 20 including a gap formed between an outer surface of said longitudinally extending body and an inner surface of said outer shell.

26. The converter assembly according to claim 25 including a mat positioned within said gap.

27. The converter assembly according to claim 20 including at least one pipe connection welded to an outer diameter of one of said first and said second conical end portions of said outer shell.

* * * * *

UNITED STATES PATENT AND TRADEMARK OFFICE

CERTIFICATE OF CORRECTION

PATENT NO. : 7,378,061 B2
APPLICATION NO. : 10/952050
DATED : May 27, 2008
INVENTOR(S) : Barnard It is certified that error appears in the above-identified patent and that said Letters Patent is hereby corrected as shown below:

ON THE TITLE PAGE:

Assignee should read as follows::

(73) Assignee: EMCON Technologies LLC, Wilmington, DE (US)

Claim 20, Column 6, line 19: “wit” should read as --with--

Signed and Sealed this

Nineteenth Day of August, 2008

JON W. DUDAS
*Director of the United States Patent and Trademark Office*